US008928212B2

(12) United States Patent
Ban et al.

(10) Patent No.: US 8,928,212 B2
(45) Date of Patent: Jan. 6, 2015

(54) SPARK PLUG

(71) Applicant: NGK Spark Plug Co., Ltd., Nagoya-shi, Aichi (JP)

(72) Inventors: Kenji Ban, Gifu (JP); Tatsunori Yamada, Seto (JP); Tomokatsu Kashima, Kiyosu (JP); Katsutoshi Nakayama, Shanghai (CN)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 14/299,026

(22) Filed: Jun. 9, 2014

(65) Prior Publication Data

US 2014/0361676 A1 Dec. 11, 2014

(30) Foreign Application Priority Data

Jun. 10, 2013 (JP) ..... 2013-122129

(51) Int. Cl.
*H01T 13/20* (2006.01)
*H01T 13/32* (2006.01)
*H01T 13/39* (2006.01)

(52) U.S. Cl.
CPC ..... *H01T 13/32* (2013.01); *H01T 13/39* (2013.01)
USPC ..... 313/141; 313/142

(58) Field of Classification Search
CPC ..... H01T 13/20; H01T 13/32
USPC ..... 313/141–145
See application file for complete search history.

(56) References Cited

U.S. PATENT DOCUMENTS

| | | | | |
|---|---|---|---|---|
| 8,013,503 | B2 | 9/2011 | Kameda et al. | 313/141 |
| 8,013,504 | B2 | 9/2011 | Kameda et al. | 313/141 |
| 8,120,235 | B2 | 2/2012 | Nunome et al. | 313/141 |
| 8,188,641 | B2 | 5/2012 | Kameda et al. | 313/142 |
| 8,324,791 | B2 | 12/2012 | Kameda et al. | 313/141 |
| 8,575,828 | B2 | 11/2013 | Kameda | 313/141 |
| 2002/0093277 | A1 * | 7/2002 | Hiramatsu | 313/141 |
| 2007/0216275 | A1 * | 9/2007 | Torii et al. | 313/141 |
| 2009/0127997 | A1 | 5/2009 | Kameda et al. | 313/141 |
| 2009/0134764 | A1 | 5/2009 | Kameda et al. | 313/141 |
| 2009/0140624 | A1 | 6/2009 | Kameda et al. | 313/141 |
| 2010/0264803 | A1 | 10/2010 | Nunome et al. | 313/141 |
| 2010/0264804 | A1 | 10/2010 | Kameda et al. | 313/141 |
| 2010/0283373 | A1 * | 11/2010 | Kameda | 313/141 |
| 2011/0025186 | A1 * | 2/2011 | Kunitomo et al. | 313/141 |

FOREIGN PATENT DOCUMENTS

| | | | |
|---|---|---|---|
| JP | 2006-236906 | 9/2006 | H01T 13/20 |
| WO | WO 2009/066714 | 5/2009 | H01T 13/32 |

* cited by examiner

*Primary Examiner* — Mariceli Santiago
(74) *Attorney, Agent, or Firm* — Kusner & Jaffe

(57) ABSTRACT

A ground electrode includes a main body portion and a projecting portion having a width smaller than a width of the main body portion. A spark discharge gap is formed between a discharging surface of the projecting portion and a front end surface of a center electrode. When the front end surface and the ground electrode are projected on a first plane, at least a part of the projection region of the projecting portion overlaps the projection region of the front end surface. A width Le (mm), a width Lc (mm), a cross-sectional area Sg ($mm^2$), a cross-sectional area Sc ($mm^2$), an angle θ1 (°), an angle θ2 (°), an angle θ3 (°), and an angle θ4 (°) satisfy expressions $Le<Lc$, $2.9 \leq Sc+Sg \leq 4.25$, and $0.30 \leq (\theta 1/\theta 2) \times (\theta 3/\theta 4) \leq 0.67$.

6 Claims, 14 Drawing Sheets

SPARK PLUG

RELATED APPLICATIONS

This application claims priority from Japanese Patent Application No. 2013-122129 filed with the Japan Patent Office on Jun. 10, 2013, the entire content of which is hereby incorporated by reference.

FIELD OF THE INVENTION

This disclosure relates to a spark plug used for an internal combustion engine or a similar engine.

BACKGROUND OF THE INVENTION

A spark plug used for an internal combustion engine or a similar engine includes, for example, an insulator, a center electrode, a tubular metal shell, and a rod-shaped ground electrode. The insulator has an axial hole extending along a direction of an axial line. The center electrode is disposed to be inserted in a front end side of the axial hole. The metal shell is disposed on an outer periphery of the insulator. The ground electrode is secured to the front end portion of the metal shell. Also, a spark discharge gap is formed between a front end portion of the ground electrode and a front end portion of the center electrode. When a voltage is applied to the spark discharge gap, a spark discharge is generated.

In addition, in a known technique for enhancing the ignitability and durability, a chip made of a noble metal alloy or a similar alloy is disposed at the front end portion of the ground electrode. The gap is formed between the chip and the center electrode. Furthermore, a technique is proposed for further enhancing the ignitability (for example, see WO 2009/066714). In this technique, a chip is bonded to the front end surface of the ground electrode and projects from the front end surface. This allows reducing flame quenching by the ground electrode.

SUMMARY OF THE INVENTION

A spark plug, includes:

a tubular insulator having an axial hole passing through the tubular insulator along a direction of an axial line;

a center electrode disposed to be inserted in a front end side of the axial hole;

a tubular metal shell disposed on an outer periphery of the insulator; and a rod-shaped ground electrode disposed at a front end portion of the metal shell, wherein:

the ground electrode includes:

a rod-shaped main body portion including a flat-shaped internal surface facing a side of a front end surface of the center electrode at a front end portion of the main body portion, the main body portion having a base end portion secured to the front end portion of the metal shell; and a projecting portion disposed at a front end portion of the main body portion in a state of projecting from a front end surface of the main body portion and the internal surface of the main body portion, the projecting portion having a width smaller than a width of the main body portion, wherein a gap is formed between a discharging surface of the projecting portion positioned at a side of the center electrode and the front end surface of the center electrode, at least a part of a projection region of the projecting portion overlaps a projection region of the front end surface of the center electrode when the front end surface of the center electrode and the ground electrode are projected along the axial line onto the first plane perpendicular to the axial line, a width Le (mm), a width Lc (mm), a cross-sectional area Sg ($mm^2$), a cross-sectional area Sc ($mm^2$), an angle θ1 (°), an angle θ2 (°), an angle θ3 (°), and an angle θ4 (°) satisfy following expressions (1), (2), and (3):

$$Le<Lc \quad (1)$$

$$2.9 \leq Sc+Sg \leq 4.25 \quad (2)$$

$$0.30 \leq (\theta 1/\theta 2) \times (\theta 3/\theta 4) \leq 0.67 \quad (3),$$

the width Le is a width of a portion in the projection region of the projecting portion, corresponding to the discharging surface of the projecting portion when the ground electrode is projected along the center axis onto the second plane perpendicular to the center axis of the main body portion at the front end portion of the main body portion, the width Lc is a width of a portion in a projection region of the center electrode, corresponding to the front end surface of the center electrode when the center electrode is projected onto the second plane along the center axis, the cross-sectional area Sg is a cross-sectional area of a portion of the front end portion of the main body portion disposed at a base end side of the main body portion with respect to the projecting portion in a cross section perpendicular to the center axis of the main body portion, the cross-sectional area Sc is a cross-sectional area of a front end portion of the center electrode in a cross section perpendicular to the axial line, the angle θ1 is formed by first tangent lines intersecting with each other at a side of the front end surface of the main body portion when the center electrode and the ground electrode are projected onto the first plane along the axial line, in which the first tangent lines are drawn from end points, respectively, that correspond to width direction ends of the front end surface of the main body portion in a projection region of the main body portion and each first tangent line comes in contact with a region of the front end surface of the center electrode at an opposite side of a base end of the main body portion with respect to a center of the center electrode in a projection region of the center electrode, the angle θ2 is formed by second tangent lines intersecting with each other at a side of a front end surface of the projecting portion when the center electrode and the ground electrode are projected onto the first plane along the axial line, in which the second tangent lines are drawn from the end points, respectively, that correspond to the width direction ends of the front end surface of the main body portion in the projection region of the main body portion and each second tangent line comes in contact with a nearest portion of the front end surface of the projecting portion to the respective end points in a projection region of the projecting portion, the angle θ3 is formed by third tangent lines intersecting with each other at a side of the internal surface of the main body portion when the center electrode and the ground electrode are projected onto the second plane along the center axis, in which the third tangent lines are drawn from end points, respectively, that correspond to width direction ends of the internal surface of the main body portion in the projection region of the main body portion and each third tangent line comes in contact with a nearest portion of the front end surface of the center electrode to the respective end points in the projection region of the center electrode and the angle θ4 is formed by fourth tangent lines intersecting with each other at a side of the discharging surface of the projecting portion when the center electrode and the ground electrode are projected onto the second plane along the center axis, in which the fourth tangent lines are drawn from the end points, respectively, that correspond to the width direction ends of the internal surface of the main body portion in the projection region of the main body portion and each fourth tangent line comes in contact with a nearest portion of the discharging surface to the respective end points in the projection region of the projecting portion.

DETAILED DESCRIPTION OF THE INVENTION

Figure 1:
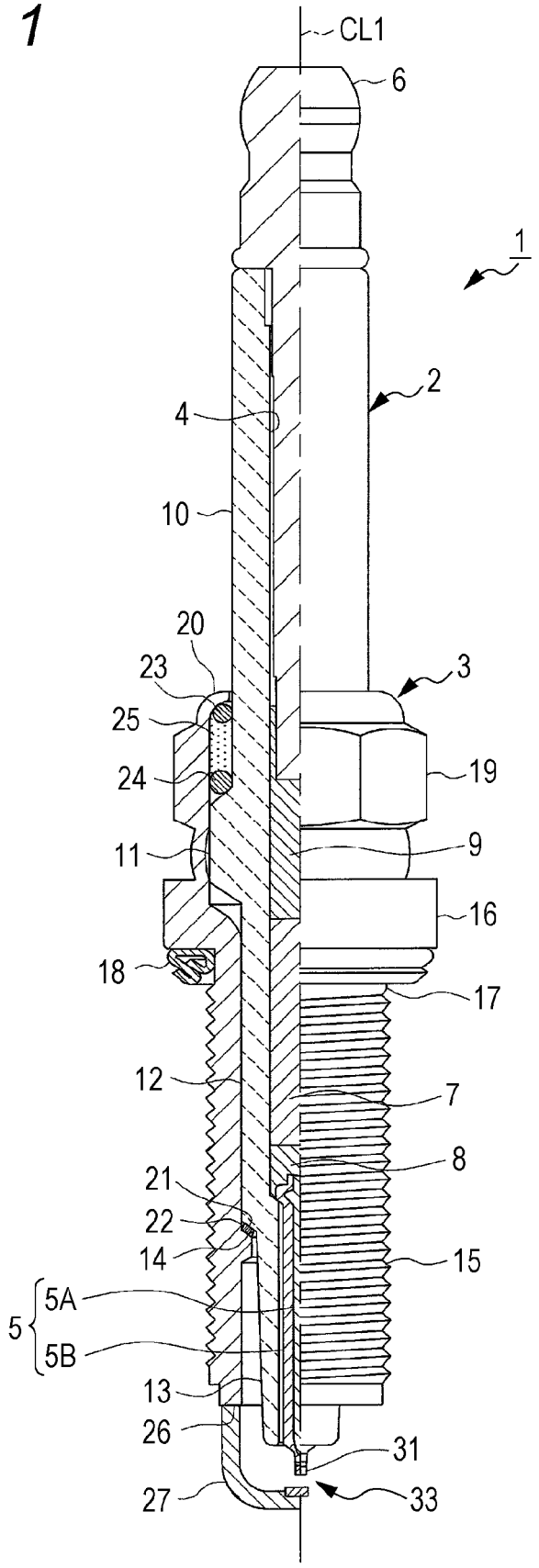
FIG. 1 is a partially sectioned front view of a constitution of a spark plug.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Recently, an internal combustion engine or a similar engine are highly compressed, supercharged, and have increased flow rate in a combustion chamber in order to, for example, enhance the fuel efficiency. This sometimes results in more difficulty for igniting the air-fuel mixture. Accordingly, it is desirable to further enhance the ignitability.

Figure 15A:
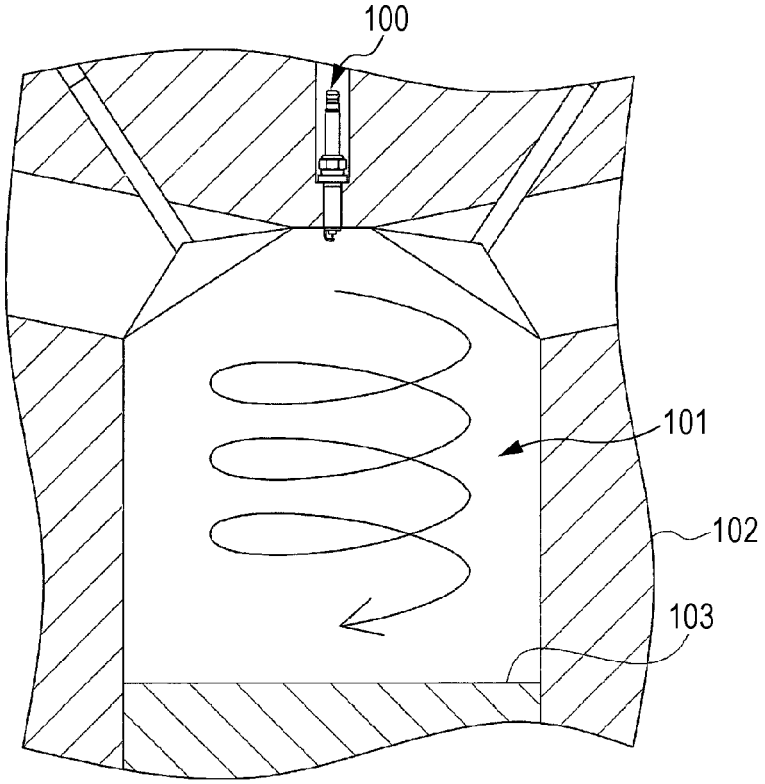
FIG. 15A is an explanatory view of a swirl flow generated in a combustion chamber.
Figure 15B:
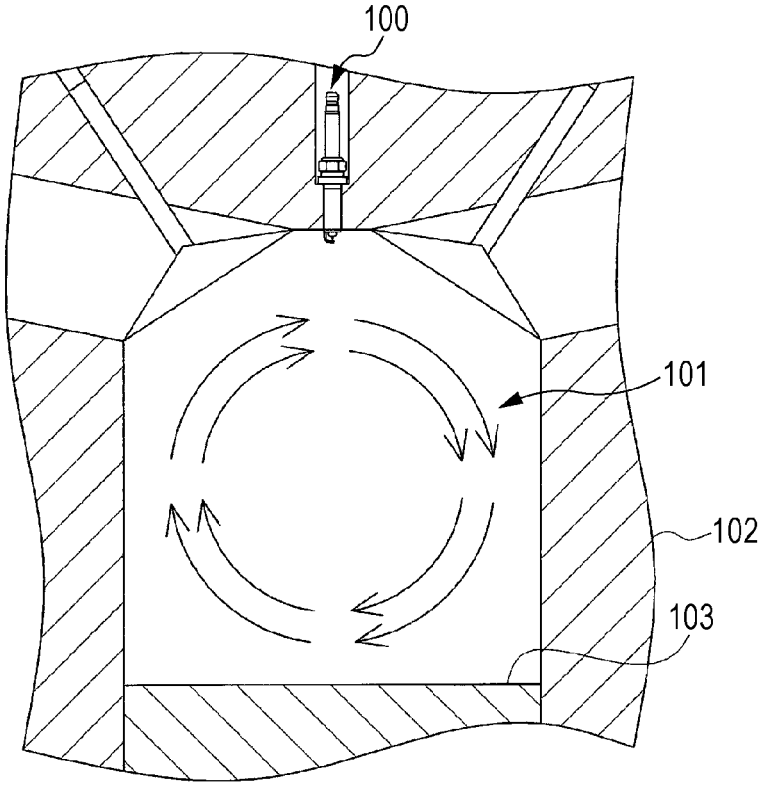
FIG. 15B is an explanatory view of a tumble flow generated in the combustion chamber.

In addition, it is known that some internal combustion engines generate a swirl flow as illustrated in FIG. 15A while others generate a tumble flow as illustrated in FIG. 15B. The swirl flow circulates in such a way as to rotate around an outer periphery of a shaft of a cylinder 102 in a combustion chamber 101 as illustrated in FIG. 15A. Meanwhile, the tumble flow circulates such a way as to repeat flowing toward a piston 103 side and flowing toward a spark plug 100 side in the combustion chamber 101 as illustrated in FIG. 15B. Especially an internal combustion engine generating the tumble flow may further have a difficulty for ensuring excellent ignitability.

An object of this disclosure is to provide a spark plug that can maintain good durability and can further improve ignitability.

Constitutions suitable for achieving the above object will next be described in itemized form. If needed, actions and effects peculiar to the constitutions will be described additionally.

Constitution 1. A spark plug of the present constitution, includes:

a tubular insulator having an axial hole passing through the tubular insulator along a direction of an axial line;

a center electrode disposed to be inserted in a front end side of the axial hole;

a tubular metal shell disposed on an outer periphery of the insulator; and a rod-shaped ground electrode disposed at a front end portion of the metal shell, wherein:

the ground electrode includes:

a rod-shaped main body portion including a flat-shaped internal surface facing a side of a front end surface of the center electrode at a front end portion of the main body portion, the main body portion having a base end portion secured to the front end portion of the metal shell; and a projecting portion disposed at a front end portion of the main body portion in a state of projecting from a front end surface of the main body portion and the internal surface of the main body portion, the projecting portion having a width smaller than a width of the main body portion, wherein a gap is formed between a discharging surface of the projecting portion positioned at a side of the center electrode and the front end surface of the center electrode, at least a part of a projection region of the projecting portion overlaps a projection region of the front end surface of the center electrode when the front end surface of the center electrode and the ground electrode are projected along the axial line onto the first plane perpendicular to the axial line, a width Le (mm), a width Lc (mm), a cross-sectional area Sg ($mm^2$), a cross-sectional area Sc ($mm^2$), an angle θ1 (°), an angle θ2 (°), an angle θ3 (°), and an angle θ4 (°) satisfy following expressions (1), (2), and (3):

$$Le<Lc \quad (1)$$

$$2.9 \leq Sc+Sg \leq 4.25 \quad (2)$$

$$0.30 \leq (\theta 1/\theta 2)\times(\theta 3/\theta 4) \leq 0.67 \quad (3),$$

the width Le is a width of a portion in the projection region of the projecting portion, corresponding to the discharging surface of the projecting portion when the ground electrode is projected along the center axis onto the second plane perpendicular to the center axis of the main body portion at the front end portion of the main body portion, the width Lc is a width of a portion in a projection region of the center electrode, corresponding to the front end surface of the center electrode when the center electrode is projected onto the second plane along the center axis, the cross-sectional area Sg is a cross-sectional area of a portion of the front end portion of the main body portion disposed at a base end side of the main body portion with respect to the projecting portion in a cross section perpendicular to the center axis of the main body portion, the cross-sectional area Sc is a cross-sectional area of a front end portion of the center electrode in a cross section perpendicular to the axial line, the angle θ1 is formed by first tangent lines intersecting with each other at a side of the front end surface of the main body portion when the center electrode and the ground electrode are projected onto the first plane along the axial line, in which the first tangent lines are drawn from end points, respectively, that correspond to width direction ends of the front end surface of the main body portion in a projection region of the main body portion and each first tangent line comes in contact with a region of the front end surface of the center electrode at an opposite side of a base end of the main body portion with respect to a center of the center electrode in a projection region of the center electrode, the angle θ2 is formed by second tangent lines intersecting with each other at a side of a front end surface of the projecting portion when the center electrode and the ground electrode are projected onto the first plane along the axial line, in which the second tangent lines are drawn from the end points, respectively, that correspond to the width direction ends of the front end surface of the main body portion in the projection region of the main body portion and each second tangent line comes in contact with a nearest portion of the front end surface of the projecting portion to the respective end points in a projection region of the projecting portion, the angle θ3 is formed by third tangent lines intersecting with each other at a side of the internal surface of the main body portion when the center electrode and the ground electrode are projected onto the second plane along the center axis, in which the third tangent lines are drawn from end points, respectively, that correspond to width direction ends of the internal surface of the main body portion in the projection region of the main body portion and each third tangent line comes in contact with a nearest portion of the front end surface of the center electrode to the respective end points in the projection region of the center electrode and the angle θ4 is formed by fourth tangent lines intersecting with each other at a side of the discharging surface of the projecting portion when the center electrode and the ground electrode are projected onto the second plane along the center axis, in which the fourth tangent lines are drawn from the end points, respectively, that correspond to the width direction ends of the internal surface of the main body portion in the projection region of the main body portion and each fourth tangent line comes in contact with a nearest portion of the discharging surface to the respective end points in the projection region of the projecting portion.

According to the above-described constitution 1, at least a part of the projection region of the projecting portion overlaps the projection region of the front end surface of the center electrode. Therefore, a spark discharge is generated mainly between the projecting portion and the front end surface of the center electrode. Furthermore, the above-described constitution 1 satisfies the expression Le<Lc. Accordingly, a width (outside diameter) of the front end portion of the center electrode is larger than a width of the projecting portion. This allows increasing a movable amount of a spark discharge crawling on the front end surface of the center electrode when the spark discharge is blown to flow. Accordingly, the spark discharge can be maintained over a long period of time. Consequently, the ignitability can be enhanced.

Also, as described above, the spark discharge is generated mainly between the projecting portion and the center electrode. Since the expression Le<Lc is satisfied, the spark discharge is generated not only between the projecting portion and the center electrode but also between the center electrode and the main body portion. This allows dispersing portions consumed with the spark discharge in the ground electrode. Consequently, the durability of the ground electrode can be enhanced.

Note that when an expression Le≥Lc is satisfied, the spark discharge can be maintained further over a long period of time in a condition in which a swirl flow is generated. However, when the expression Le≥Lc is satisfied, the spark discharge is easily blown off in a condition in which a tumble flow is generated. Accordingly, the ignitability cannot be enhanced. In contrast to this, since the expression Le<Lc is satisfied, similar to the above-described constitution 1, the spark discharge can be maintained over a long period of time even in the condition in which the tumble flow is generated. Consequently, the ignitability can be enhanced. Accordingly, the spark plug having the above-described constitution 1 is preferably applied to an internal combustion engine in which the tumble flow is generated.

In addition, the above-described constitution 1 satisfies the expression $2.9 \leq Sc+Sg \leq 4.25$. Accordingly, flame quenching by the center electrode and the main body portion can be reduced while the consumption volume of the center electrode and the main body portion is sufficiently obtained. Consequently, the ignitability and durability can be further enhanced.

Furthermore, the inventors of the present application devoted themselves to examination of the angles θ1 through θ4. As a result, they found that the satisfaction of the expression $0.30 \leq (\theta1/\theta2) \times (\theta3/\theta4) \leq 0.67$ allows further enhancing the ignitability and durability without losing the above-described enhancing effects of the ignitability and durability. Accordingly, the above-described constitution 1 makes it possible to further enhance the ignitability and durability.

As described above, with the above-described constitution 1, the above-described operational advantages work synergistically. This allows the above-described constitution 1 to provide excellent performance in both ignitability and durability.

Constitution 2. In the spark plug of the present constitution according to constitution 1, an expression $0.32 \leq (\theta1/\theta2) \times (\theta3/\theta4) \leq 0.61$ is satisfied.

The inventors of the present application devoted themselves to examination of the angles θ1 through θ4. As a result, they found that the satisfaction of the expression $0.32 \leq (\theta1/\theta2) \times (\theta3/\theta4) \leq 0.61$ allows further enhancing the ignitability and durability. Accordingly, the above-described constitution 2 can provide more excellent performance in both ignitability and durability.

Constitution 3. In the spark plug of the present constitution according to constitution 1 or 2, the projecting portion is made of a metal including platinum as a main component.

Note that a main component refers to a component having the highest mass ratio in the material (the same shall apply hereinafter).

The above-described constitution 3 can provide good anti-consumption property of the projecting portion. As a result, the durability can be further enhanced. Also, the good anti-consumption property can be ensured, which allows further reducing the width of the projecting portion. Consequently, the ignitability can be further enhanced.

Constitution 4. In the spark plug of the present constitution according to constitution 1 or 2, the projecting portion is made of a metal including iridium as a main component.

The above-described constitution 4 can enhance the anti-consumption property of the projecting portion. Accordingly, the durability can be further enhanced. Also, the good anti-consumption property can be ensured, which allows further reducing the width of the projecting portion. Consequently, the ignitability can be further enhanced.

One embodiment of this disclosure will be described below with reference to the drawings. FIG. 1 is a partially sectioned front view of a spark plug 1. Notably, in FIG. 1, an axial line CL1 direction of the spark plug 1 is referred to as the vertical direction in the drawing. The lower side of the spark plug 1 is referred to as the front end side of the spark plug 1, and the upper side is referred to as the rear end side.

The spark plug 1 includes a tubular insulator 2 as an insulator, a tubular metal shell 3, which holds the insulator 2, or similar components.

As well known in the art, the insulator 2 is made by, for example, firing an alumina or a similar material. The insulator 2 has outer peripheral portions including a rear trunk portion 10 disposed at the rear end side, a large-diameter portion 11, an intermediate trunk portion 12, and an insulator nose portion 13. The large-diameter portion 11 is disposed frontward side with respect to the rear trunk portion 10, and projects radially outward. The intermediate trunk portion 12 is disposed frontward side with respect to the large-diameter portion 11, and has a diameter smaller than that of the large-diameter portion 11. The insulator nose portion 13 is disposed frontward side with respect to the intermediate trunk portion 12, and has a diameter smaller than that of the intermediate trunk portion 12. The metal shell 3 houses the large-diameter portion 11, the intermediate trunk portion 12, and most part of the insulator nose portion 13 of the insulator 2. In addition, a taper-shaped step portion 14 is disposed at a connecting portion of the intermediate trunk portion 12 and insulator nose portion 13. The insulator 2 is locked to the metal shell 3 at the step portion 14.

Further, the insulator 2 has an axial hole 4. The axial hole 4 passes through and extends the insulator 2 along the axial line CL1. A center electrode 5 is disposed to be inserted in the axial hole 4 at the front end side. The center electrode 5 includes an inner layer 5A including a metal having an excellent thermal conductivity (for example, a copper and a copper alloy), and an outer layer 5B including an alloy including a nickel (Ni) as a main component. In addition, the center electrode 5 includes, at the front end portion, a column-shaped center electrode side chip 31 including a metal having an excellent anti-consumption property. In this embodiment, the center electrode side chip 31 is made of a metal having an excellent anti-consumption property (for example, a metal including one or more of a platinum (Pt), an iridium (Ir), a palladium (Pd), a rhodium (Rh), a ruthenium (Ru), and a rhenium (Re) or a similar material). Also, the entire body of the center electrode 5 has a rod shape (a column shape), and the center electrode 5 projects from the front end of the insulator 2.

In addition, a terminal electrode 6 is inserted in and secured to the axial hole 4 at a rear end side, so as to project from the rear end of the insulator 2.

Further, a column-shaped resistor 7 is disposed within the axial hole 4 between the center electrode 5 and the terminal electrode 6. Both end portions of the resistor 7 are electrically connected to the center electrode 5 and the terminal electrode 6, respectively via electrically conductive glass seal layers 8 and 9.

In addition, the metal shell 3 has a pipe shape and is made of low-carbon steel or a similar metal. The metal shell 3 includes a thread portion (external thread portion) 15 on an outer peripheral surface. The thread portion 15 is adapted to mount the spark plug 1 into a mounting hole of a combustion apparatus (for example, an internal combustion engine or a fuel cell reformer). Also, the metal shell 3 includes a seat portion 16, which projects radially outward, on an outer peripheral surface at a rear end side with respect to the thread portion 15. A ring-shaped gasket 18 is engaged with a thread root 17 at the rear end of the thread portion 15. Further, a tool engagement portion 19 having a hexagonal cross section and a crimping portion 20 are disposed at a rear end side of the metal shell 3. The tool engagement portion 19 is a portion with which a tool such as a wrench is engaged when the metal shell 3 is mounted to the combustion apparatus. The crimping portion 20 is used for holding the insulator 2 at the rear end portion of the metal shell 3.

A taper-shaped step portion 21 is disposed on an inner circumferential surface of the metal shell 3 for locking the insulator 2. Then, the insulator 2 is inserted into the metal shell 3 from the rear end side toward the front end side of the metal shell 3. The insulator 2 is secured to the metal shell 3 by radially inwardly crimping an opening portion at a rear end side of the metal shell 3 (in other word, by forming the above-described crimping portion 20) with locking the step portion 14 of the insulator 2 to the step portion 21 of the metal shell 3. Note that an annular-shaped plate packing 22 is interposed between the step portion 14 and the step portion 21. The plate packing 22 keeps air tightness in the combustion chamber. Further, the plate packing 22 suppresses or prevents outward leakage of a fuel gas that enters a clearance between the inner circumferential surface of the metal shell 3 and the insulator nose portion 13 of the insulator 2, which is exposed in the combustion chamber.

Further, in order to ensure more complete sealing with crimping, annular-shaped ring members 23 and 24 are interposed between the metal shell 3 and the insulator 2 at the rear end side of the metal shell 3, and a space between the ring members 23 and 24 is filled with powders of talc 25. That is, the metal shell 3 holds the insulator 2 via the plate packing 22, the ring members 23 and 24, and the talc 25.

Figure 2:
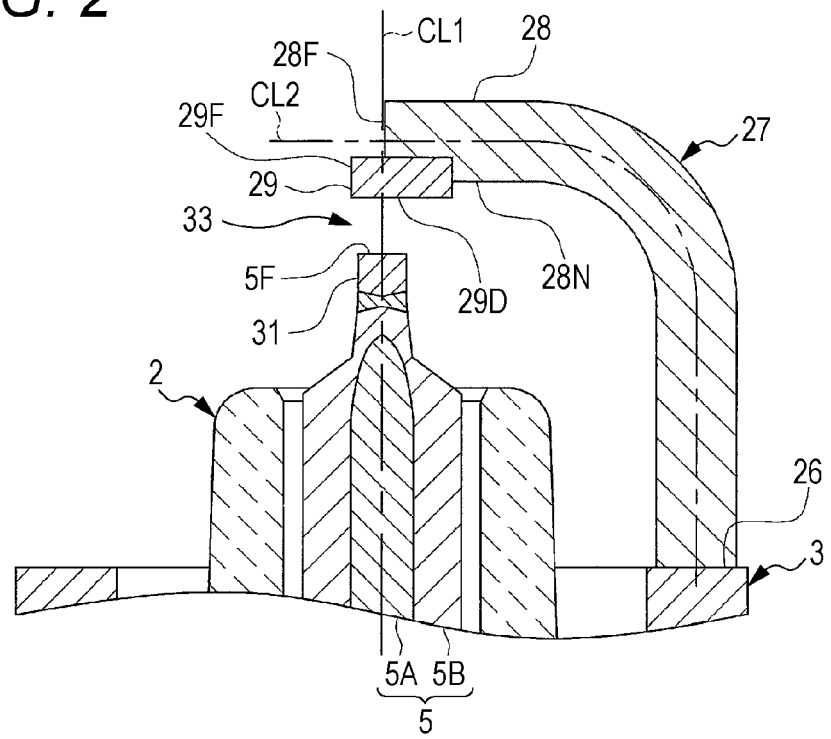
FIG. 2 is an enlarged cross-sectional view of a constitution of a front end portion of the spark plug.
Figure 3:
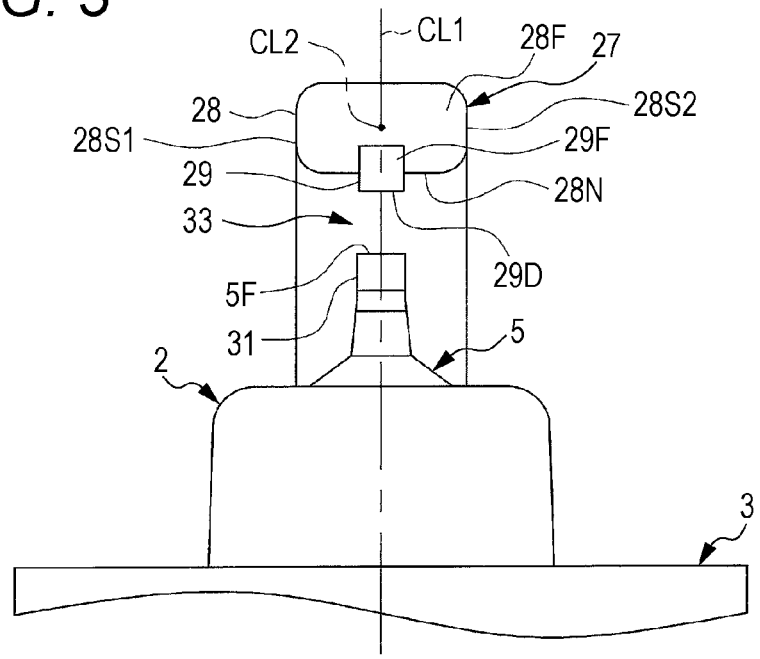
FIG. 3 is an enlarged side view of a constitution of the front end portion of the spark plug.

Also, a rod-shaped ground electrode 27 is disposed at a front end portion 26 of the metal shell 3 as illustrated in FIG. 2. As illustrated in FIGS. 2 and 3, the ground electrode 27 includes a rod-shaped main body portion 28 and a projecting portion 29. The main body portion 28 is made of, for example, an alloy including a Ni as a main component. The projecting portion 29 is disposed at the front end portion the of the main body portion 28.

The main body portion 28 is bent back at an intermediate portion of the main body portion 28. The main body portion 28 includes, at a front end portion of the main body portion 28, a flat-shaped internal surface 28N facing a side of a front end surface 5F of the center electrode 5. Also, a base end portion of the main body portion 28 is bonded to the front end portion 26 of the metal shell 3. Accordingly, the ground electrode 27 is disposed at the front end portion of the metal shell 3. Further, in this embodiment, the portions of the main body portion 28 corresponding to corners of a rectangular in cross section perpendicular to a center axis CL2 of the main body portion 28 have an outwardly curved convex shape. That is, the main body portion 28 has an approximately constant width along the longitudinal direction of the main body portion 28.

The projecting portion 29 has a rectangular parallelepiped shape. In this embodiment, the projecting portion 29 is made of a metal including a Pt as a main component or a metal including an Ir as a main component. Further, a discharging surface 29D, a surface of the projecting portion 29 that is positioned at a side of the center electrode 5, faces the front end surface 5F of the center electrode 5. A spark discharge gap 33, as a gap, is formed between the discharging surface 29D and the front end surface 5F. Then, a spark discharge is generated at the spark discharge gap 33 in a direction approximately along the axial line CL1 by applying a voltage to the spark discharge gap 33. Note that, in this embodiment, a size of the spark discharge gap 33 (the shortest distance between the front end surface 5F and the discharging surface 29D) is set within a range of the predetermined values (for example, equal to or more than 0.5 mm and equal to or less than 1.1 mm).

Also, the projecting portion 29 has a front end surface 29F projecting from a front end surface 28F of the main body portion 28. Further, the projecting portion 29 is bonded to the front end portion of the main body portion 28 with the discharging surface 29D projecting from the internal surface 28N of the main body portion 28. In addition, a width of the projecting portion 29 is smaller than a width of the main body portion 28.

Further, in this embodiment, the center electrode 5, the main body portion 28, and the projecting portion 29 meet a following positional relation.

Figure 4:
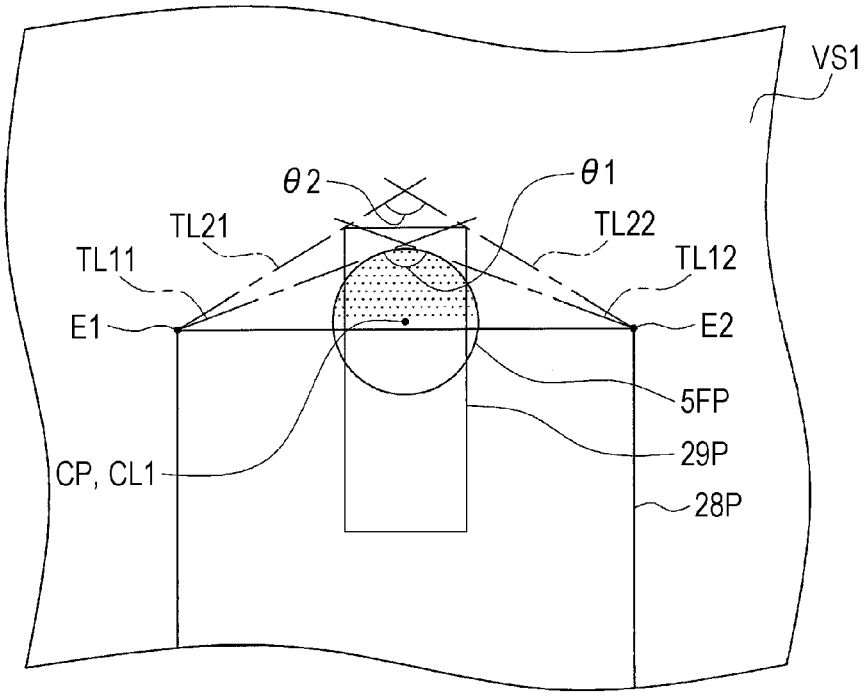
FIG. 4 is a projection view of a center electrode etc. projected onto a first plane.

That is, as illustrated in FIG. 4, the front end surface 5F of the center electrode 5 and the ground electrode 27 (the main body portion 28 and the projecting portion 29) are projected onto a first plane VS1, which is a plane perpendicular to the axial line CL1, along the axial line CL1. At this time, at least a part of a projection region 29P of the projecting portion 29 overlaps a projection region 5FP of the front end surface 5F.

Figure 5:
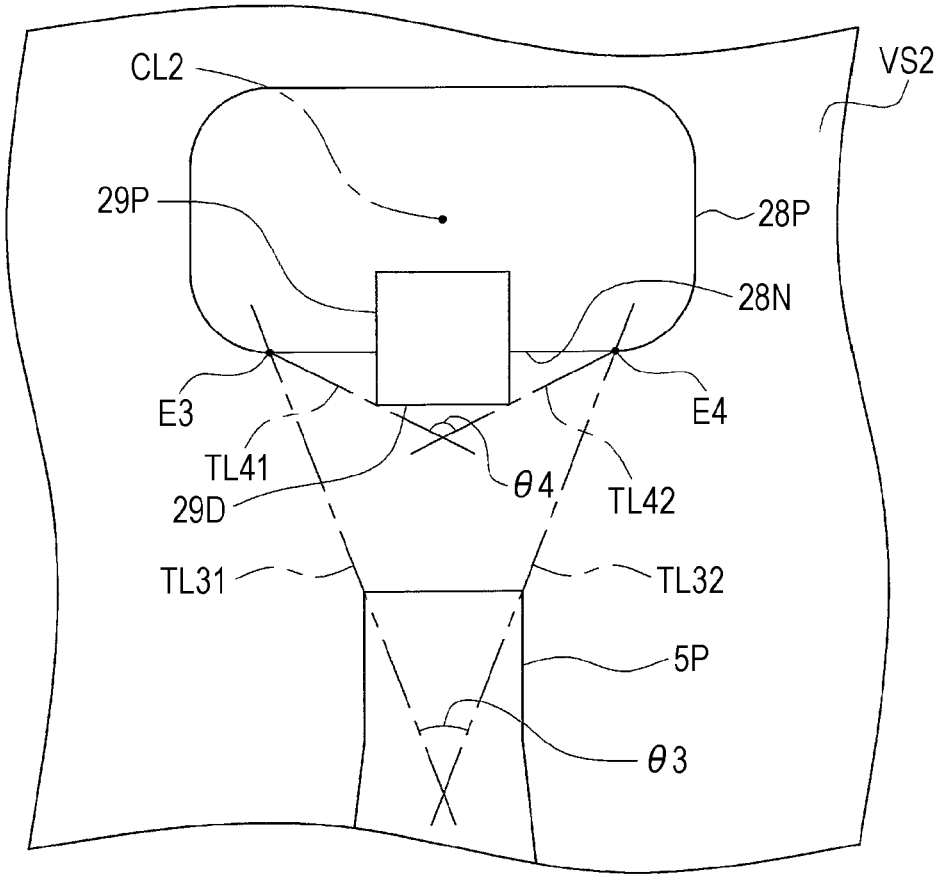
FIG. 5 is a projection view of the center electrode etc. projected onto a second plane.

Further, as illustrated in FIG. 4, the angle θ1 (°) and the angle θ2 (°) are formed on the first plane VS1 when the center electrode 5 and the ground electrode 27 are projected onto the first plane VS1 along the axial line CL1. As illustrated in FIG. 5, the angle θ3 (°) and the angle θ4 (°) are formed on a second plane VS2 when the center electrode 5 and the ground electrode 27 are projected, along the center axis CL2, onto the second plane VS2, which is a plane perpendicular to the center axis CL2 of the main body portion 28 at the front end portion of the main body portion 28. In the spark plug 1, the angle θ1 (°), the angle θ2 (°), the angle θ3 (°) and the angle θ4 (°) satisfy the expression $0.30 \leq (\theta 1/\theta 2) \times (\theta 3/\theta 4) \leq 0.67$. Note that the angles θ1 through θ4 more preferably satisfy the expression $0.32 \leq (\theta 1/\theta 2) \times (\theta 3/\theta 4) \leq 0.61$.

Also, the angle θ1 is specified as follows. That is, as illustrated in FIG. 4, the center electrode 5 and the ground electrode 27 are projected onto the first plane VS1 along the axial line CL1. Further, two first tangent lines TL11 and TL12 intersect with each other and are drawn from end points E1 and E2, respectively, that correspond to width direction ends of the front end surface 28F of the main body portion 28 in a projection region 28P of the main body portion 28. Each first tangent line TL11, TL12 comes in contact with a region (dot-patterned region in FIG. 4) of the front end surface 5F at an opposite side of a base end of the main body portion 28 with respect to the center point CP in the projection region 5FP of the front end surface 5F. At this time, the angle θ1 is formed by the first tangent lines TL11 and TL12 at the front end surface 28F side of the main body portion 28.

Note that some cases have a curvature between a line corresponding to the front end surface 28F in the projection region 28P and, two lines respectively corresponding to side surfaces 28S1 and 28S2 (illustrated in FIG. 3) of the main body portion 28 of the projection region 28P. In such cases, both end points E1 and E2 are intersection points of the line corresponding to the front end surface 28F and the two lines respectively corresponding to the side surfaces 28S1 and 28S2.

Further, the angle θ2 is specified as follows. That is, the center electrode 5 and the ground electrode 27 are projected onto the first plane VS1 along the axial line CL1. Further, two second tangent lines TL21 and TL22 intersect with each other and are drawn from the end points E1 and E2, respectively. Each tangent line TL21, TL22 comes in contact with a portion of the front end surface 29F nearest to the respective end points E1, E2 in the projection region 29P. At this time, the angle θ2 is formed by the second tangent lines TL21 and TL22 at the front end surface 29F side of the projecting portion 29.

In addition, the angle θ3 is specified as follows. That is, as illustrated in FIG. 5, the center electrode 5 and the ground electrode 27 are projected onto the second plane VS2 along the center axis CL2. Further, end points E3 and E4 correspond to width direction ends of the internal surface 28N of the main body portion 28 in the projection region 28P of the main body portion 28. Further, two third tangent lines TL31 and TL32 intersect with each other and are drawn from the end points E3 and E4, respectively. Each third tangent line TL31, TL32 comes in contact with a portion of the front end surface 5F nearest to the respective end points E3, E4 in a projection region 5P of the center electrode 5. At this time, the angle θ3 is formed by the third tangent lines TL31 and TL32 at the internal surface 28N side of the main body portion 28.

Additionally, the angle θ4 is specified as follows. That is, the center electrode 5 and the ground electrode 27 are projected onto the second plane VS2 along the center axis CL2. Further, two fourth tangent lines TL41 and TL42 intersect with each other and are drawn from the end points E3 and E4, respectively. Each tangent line TL41, TL42 comes in contact with a portion of the discharging surface 29D nearest to the respective end points E3, E4 in the projection region 29P of the projecting portion 29. At this time, the angle θ4 is formed by the fourth tangent lines TL41 and TL42 at the discharging surface 29D side of the projecting portion 29.

Figure 6:
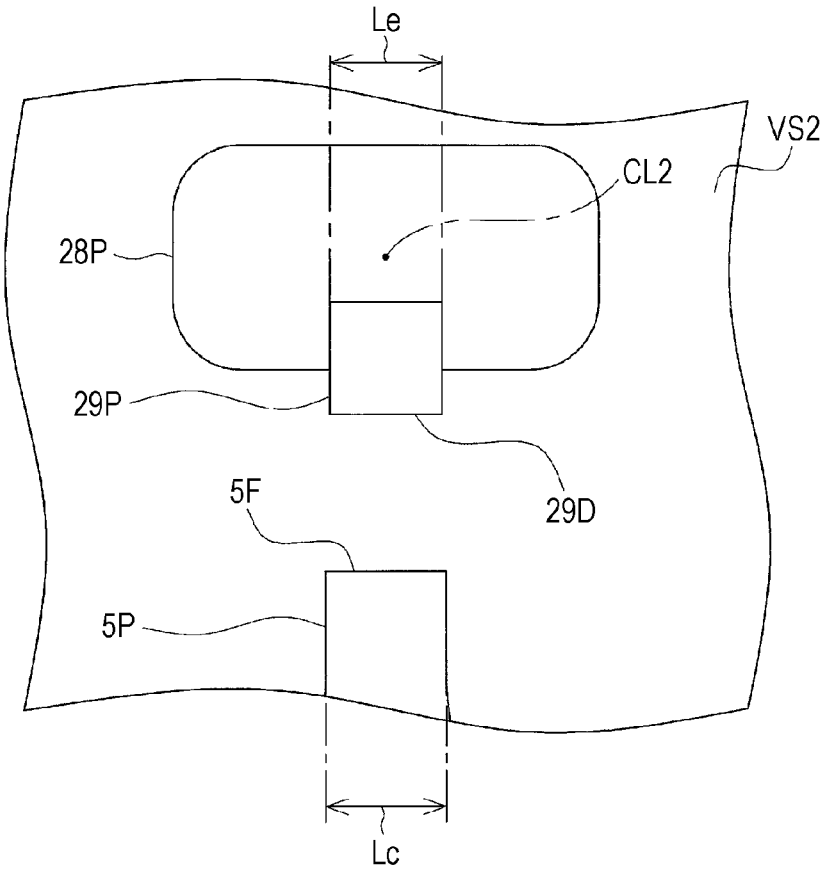
FIG. 6 a projection view of the center electrode etc. projected onto the second plane.

Also, as illustrated in FIG. 6, the center electrode 5 and the ground electrode 27 are projected onto the second plane VS2 along the center axis CL2. Then, the width Le (mm) is set to a width of a portion in the projection region 29P of the projecting portion 29, corresponding to the discharging surface 29D of the projecting portion 29. Further, the width Lc (mm) is set to a width of a portion in the projection region 5P of the center electrode 5, corresponding to the front end surface 5F of the center electrode 5. At this time, the spark plug 1 is constituted to satisfy the expression $Le < Lc$. That is, the spark plug 1 is configured to make the width (outside diameter) of the front end surface 5F of the center electrode 5 larger than the width of the discharging surface 29D of the projecting portion 29. Note that, in this embodiment, the width Le is set in a range of the predetermined values (for example, equal to or more than 0.4 mm and equal to or less than 0.7 mm). The width Lc is set in a range of the predetermined values (for example, equal to or more than 0.6 mm and equal to or less than 1 mm). In addition, the width of the main body portion 28 is set to be larger than the outside diameter of the front end surface 5F of the center electrode 5 and is set in a range of the predetermined values (for example, equal to or more than 2 mm and equal to or less than 2.7 mm).

Figure 7A:
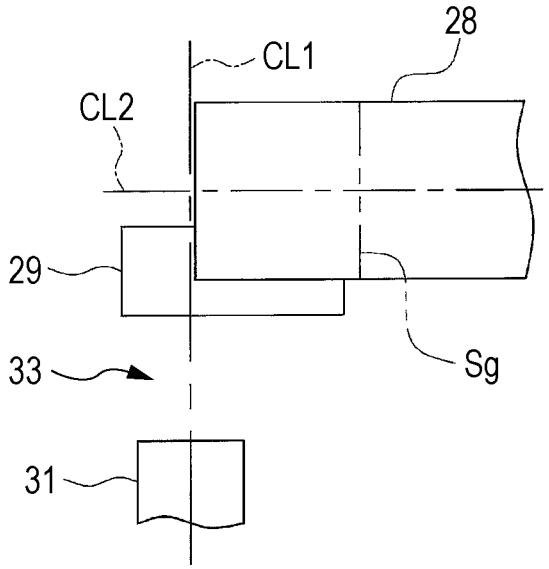
FIG. 7A is a partially enlarged front view of a front end portion or a similar portion of a main body portion.
Figure 7B:
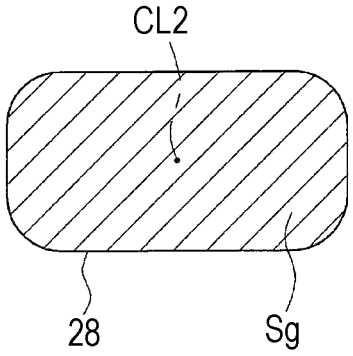
FIG. 7B is a partially enlarged cross-sectional view of a cross section of the front end portion of the main body portion.
Figure 8A:
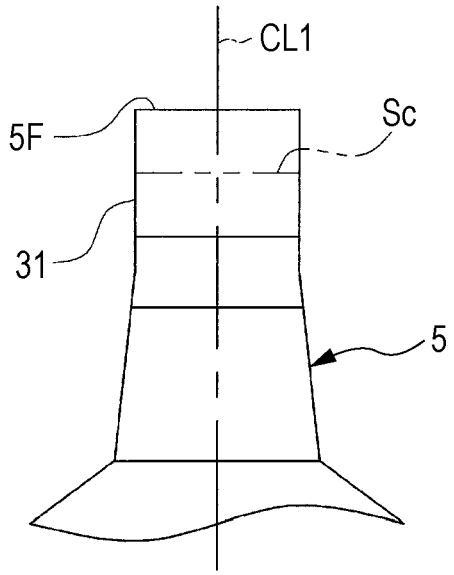
FIG. 8A is a partially enlarged front view of a front end portion of the center electrode.
Figure 8B:
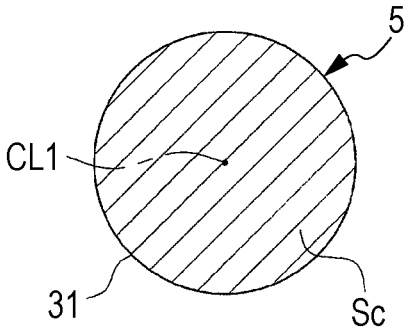
FIG. 8B is a partially enlarged cross-sectional view of a cross section of the front end portion of the center electrode.

Further, as illustrated in FIGS. 7A and 7B, a cross-sectional area Sg ($mm^2$) is set to a cross-sectional area, which is perpendicular to the center axis CL2 of the main body portion 28, at a portion of the front end portion of the main body portion 28 disposed at the base end side of the main body portion 28 with respect to the projecting portion 29. As illustrated in FIGS. 8A and 8B, the cross-sectional area Sc ($mm^2$) is set to a cross-sectional area, which is perpendicular to the axial line CL1, at the front end portion (center electrode side chip 31) of the center electrode 5. At this time, the expression $2.9 \leq Sc + Sg \leq 4.25$ is satisfied.

Note that, in this embodiment, a portion of the main body portion 28 disposed at the base end side of the main body portion 28 with respect to the projecting portion 29 has a cross-sectional area which is perpendicular to the center axis CL2 and approximately constant along the center axis CL2. Also, the front end portion of the center electrode 5 has a cross-sectional area which is perpendicular to the axial line CL1 and approximately constant along the axial line CL1.

As details are described above, according to this embodiment, at least a part of the projection region 29P of the projecting portion 29 overlaps the projection region 5FP of the front end surface 5F of the center electrode 5. Accordingly, a spark discharge is generated mainly between the projecting portion and the front end surface of the center electrode. Further, in this embodiment, the expression $Le < Lc$ is satisfied. That is, the width (outside diameter) of the front end surface 5F of the center electrode 5 is larger than the width of the projecting portion 29. This allows increasing a movable amount of the spark discharge crawling on the front end surface 5F of the center electrode 5 when the spark discharge is blown to flow. Accordingly, the spark discharge can be maintained over a longer period of time. Consequently, the ignitability can be enhanced.

Also, the spark discharge is generated mainly between the projecting portion and the center electrode. Since the expression $Le < Lc$ is satisfied, the spark discharge is generated not only between the projecting portion and the center electrode but also between the center electrode and the main body portion. This allows dispersing portions consumed by the spark discharge in the ground electrode. Consequently, the durability of the ground electrode can be enhanced.

Note that when the expression $Le < Lc$ is satisfied, good ignitability can be achieved even in a condition in which a tumble flow is generated. That is, the spark plug 1 according to this embodiment is preferably applied to an internal combustion engine that generates the tumble flow.

Also, in this embodiment, the expression $2.9 \leq Sc + Sg \leq 4.25$ is satisfied. Accordingly, flame quenching by the center electrode 5 and the main body portion 28 can be suppressed while the consumption volume of the center electrode 5 and the main body portion 28 is sufficiently obtained. Consequently, the ignitability and durability can be further enhanced.

Further, in this embodiment, the expression $0.30 \leq (\theta 1/\theta 2) \times (\theta 3/\theta 4) \leq 0.67$ is satisfied. This allows further enhancing the ignitability and durability without losing the above-described enhancing effects of the ignitability and durability.

Note that when the expression $0.32 \leq (\theta 1/\theta 2) \times (\theta 3/\theta 4) \leq 0.61$ is satisfied, the ignitability and durability can be much further enhanced.

In addition, the projecting portion 29 is made of a metal including a Pt as a main component or a metal including an Ir as a main component. Accordingly, the projecting portion 29 can obtain an excellent anti-consumption property. Consequently, the durability can be further enhanced. In addition, since the excellent anti-consumption property can be ensured, the width of the projecting portion 29 can be further reduced. Consequently, the ignitability can be further enhanced.

Next, in order to confirm the action and effect achieved by the above-described embodiment, samples of spark plugs were manufactured. An ignitability evaluation test and a durability evaluation test were conducted on the respective samples. The respective samples differ in the width Le (mm), the width Lc (mm), the cross-sectional area Sg ($mm^2$), the cross-sectional area Sc ($mm^2$), and the angles θ1 through θ4 (°).

The outline of the ignitability evaluation test is as follows. That is, the respective samples were mounted to a predetermined single-cylinder engine. Then, the engine was operated at an engine speed of 1600 rpm with ignition timing set to minimum spark advance for best torque (MBT). Then, while an air-fuel ratio (A/F) was gradually increased (fuel is lean), an engine torque variation rate was measured for each air-fuel ratio. An air-fuel ratio when the engine torque variation rate exceeds 5% was identified as a limit air-fuel ratio (note that it is considered that the ignitability is more excellent as the limit air-fuel is higher). Further, a limit air-fuel ratio (reference air-fuel ratio) for samples of a conventional product was identified using the above-described approach. The samples of the conventional product did not include a projecting portion, but included a ground electrode that had a main body portion only. Further, in the samples of the conventional product, a side surface of a front end portion of a ground electrode faced a front end surface of a center electrode (center electrode side chip). Further, in the samples of the conventional product, the outside diameter of the front end surface of the center electrode (center electrode side chip) was 0.6 mm. Then, the identified limit air-fuel ratios for the respective samples were compared with the reference air-fuel ratio. The ignitability for the respective samples was evaluated based on the comparison result. Specifically, a sample having a limit air-fuel ratio higher than the reference air-fuel ratio by equal to or more than 1.1 was considered extremely excellent in ignitability, and evaluated as "excellent." A sample having a limit air-fuel ratio higher than the reference air-fuel ratio by more than 0.0 and less than 1.1 was considered good in ignitability, and evaluated as "good." On the other hand, a sample having a limit air-fuel ratio equal to or lower than the reference air-fuel ratio by less than 1.1 was considered slightly poor in ignitability, and evaluated as "fair." A sample having a limit air-fuel ratio lower than the reference air-fuel ratio by equal to or more than 1.1 was considered poor in ignitability, and evaluated as "poor."

Also, the outline of the durability evaluation test is as follows. That is, the respective samples were mounted to a three-cylinder DOHC superchaged engine. Then, the engine was operated for 600 hours at an engine revolution of 6000 rpm. After that, a size of a spark discharge gap (gap length) was measured. An increased value (increased gap amount) relative to the gap length before the test was calculated based on the measurement result (note that it is considered that the durability is more excellent as the increased amount of the gap is smaller). Further, an increased gap amount (reference increased amount) for the samples of the conventional product was calculated using the above-described approach. Then, the increased gap amount that was calculated for the respective samples was compared with the reference increased amount. The durability for the respective samples was evaluated based on the comparison result. More specifically, a sample having an increased gap amount smaller than the reference increased amount by equal to or more than 0.21 mm was considered extremely excellent in durability, and evaluated as "excellent." A sample having an increased gap amount smaller than the reference increased amount by more than 0.00 mm and less than 0.21 mm was considered good in durability, and evaluated as "good." On the other hand, a sample having an increased gap amount equal to or greater than the reference increased amount by less than 0.21 mm was considered slightly poor in durability, and evaluated as "fair." A sample having an increased gap amount greater than the reference increased amount by equal to or more than 0.21 mm was considered poor in durability, and evaluated as "poor."

The table 1 shows the results of both tests. Note that table 1 also shows a width of the main body portion and a gap length before the test as a reference, for the respective samples. Also, the engines used for both tests have devised intake ports. This makes both engines generate a tumble flow in the combustion chambers from an introduced new air.

Further, it was apparent that the samples that satisfied the expression $0.32 \leq (\theta 1/\theta 2) \times (\theta 3/\theta 4) \leq 0.61$ (samples 19 through 28) exhibited excellent performance in both ignitability and durability.

Note that it is considered that the satisfaction of the expression Le<Lc contributes to the enhancement in ignitability. That is, it is preferred, from the view point of the enhancement in ignitability, to maintain a spark discharge over a long period of time. Thus, in a conventional technique assuming a swirl flow is generated in a combustion chamber, the width Le is set equal to or more than the width Lc. This results in increasing a movable amount of a spark discharge crawling on a surface of a ground electrode when the spark discharge is blown to flow. As a result, the spark discharge can be maintained over a long period of time. However, the following possibility is concerned with the condition in which the tumble flow is generated in the combustion chamber. That is,

TABLE 1

| No. | Width Lc (mm) | Width Le (mm) | Width of main body portion (mm) | Gap length (mm) | θ1 (°) | θ2 (°) | θ3 (°) | θ4 (°) | (θ1/θ2) × (θ3/θ4) | Sc ($mm^2$) | Sg ($mm^2$) | Sc + Sg ($mm^2$) | Ignitability evaluation | Durability evaluation |
|---|---|---|---|---|---|---|---|---|---|---|---|---|---|---|
| 1 | 0.4 | 0.4 | 2.7 | 1.1 | 110 | 121 | 57 | 139 | 0.37 | 0.13 | 3.45 | 3.58 | Fair | Poor |
| 2 | 0.4 | 1.0 | 2 | 0.6 | 110 | 75 | 64 | 83 | 1.13 | 0.13 | 2.40 | 2.53 | Fair | Fair |
| 3 | 0.8 | 1.0 | 2.7 | 1.1 | 125 | 105 | 43 | 116 | 0.44 | 0.50 | 3.45 | 3.95 | Fair | Fair |
| 4 | 0.8 | 1.0 | 2.7 | 0.6 | 125 | 105 | 64 | 116 | 0.66 | 0.50 | 3.45 | 3.95 | Fair | Fair |
| 5 | 0.8 | 1.0 | 2 | 1.1 | 106 | 75 | 28 | 83 | 0.48 | 0.50 | 2.40 | 2.90 | Fair | Poor |
| 6 | 0.8 | 1.0 | 2 | 0.6 | 106 | 75 | 43 | 83 | 0.73 | 0.50 | 2.40 | 2.90 | Fair | Poor |
| 7 | 0.6 | 1.0 | 2.7 | 0.6 | 126 | 105 | 72 | 116 | 0.74 | 0.28 | 3.45 | 3.73 | Fair | Fair |
| 8 | 1.0 | 1.0 | 2.7 | 1.1 | 124 | 105 | 36 | 116 | 0.37 | 0.80 | 3.45 | 4.25 | Poor | Fair |
| 9 | 1.0 | 1.0 | 2.7 | 0.6 | 124 | 105 | 54 | 116 | 0.55 | 0.80 | 3.45 | 4.25 | Poor | Fair |
| 10 | 0.4 | 0.35 | 1 | 0.4 | 106 | 90 | 32 | 110 | 0.34 | 0.13 | 0.30 | 0.42 | Good | Poor |
| 11 | 1.2 | 0.7 | 2.7 | 1.1 | 123 | 113 | 20 | 129 | 0.17 | 1.13 | 3.45 | 4.58 | Poor | Fair |
| 12 | 1.2 | 1.05 | 3 | 1.2 | 106 | 90 | 32 | 110 | 0.34 | 1.13 | 5.39 | 6.52 | Poor | Good |
| 13 | 1.2 | 0.7 | 2 | 1.1 | 100 | 90 | 12 | 110 | 0.12 | 1.13 | 2.40 | 3.53 | Poor | Fair |
| 14 | 1.2 | 1.0 | 2 | 1.1 | 100 | 75 | 12 | 83 | 0.19 | 1.13 | 2.40 | 3.53 | Poor | Fair |
| 15 | 0.8 | 0.4 | 2 | 1.1 | 106 | 101 | 28 | 126 | 0.23 | 0.50 | 2.40 | 2.90 | Fair | Fair |
| 16 | 0.8 | 0.7 | 2 | 1.1 | 106 | 90 | 28 | 110 | 0.30 | 0.50 | 2.40 | 2.90 | Good | Good |
| 17 | 1.0 | 0.7 | 2.7 | 1.1 | 124 | 113 | 36 | 129 | 0.31 | 0.80 | 3.45 | 4.25 | Good | Good |
| 18 | 0.8 | 0.7 | 2.7 | 0.5 | 149 | 122 | 71 | 129 | 0.67 | 0.50 | 3.45 | 3.95 | Good | Good |
| 19 | 0.8 | 0.7 | 2.7 | 1.1 | 103 | 106 | 43 | 129 | 0.32 | 0.50 | 3.45 | 3.95 | Excellent | Excellent |
| 20 | 0.6 | 0.4 | 2.7 | 0.6 | 126 | 121 | 72 | 139 | 0.54 | 0.28 | 3.45 | 3.73 | Excellent | Excellent |
| 21 | 0.8 | 0.4 | 2.7 | 0.6 | 125 | 121 | 64 | 139 | 0.48 | 0.50 | 3.45 | 3.95 | Excellent | Excellent |
| 22 | 0.8 | 0.7 | 2.7 | 0.6 | 103 | 106 | 64 | 129 | 0.48 | 0.50 | 3.45 | 3.95 | Excellent | Excellent |
| 23 | 0.8 | 0.7 | 2.7 | 0.8 | 125 | 113 | 53 | 129 | 0.45 | 0.50 | 3.45 | 3.95 | Excellent | Excellent |
| 24 | 0.8 | 0.7 | 2.7 | 0.6 | 125 | 113 | 64 | 129 | 0.55 | 0.50 | 3.45 | 3.95 | Excellent | Excellent |
| 25 | 0.8 | 0.7 | 2.7 | 1.1 | 149 | 122 | 43 | 129 | 0.41 | 0.50 | 3.45 | 3.95 | Excellent | Excellent |
| 26 | 0.8 | 0.7 | 2 | 0.8 | 106 | 90 | 32 | 110 | 0.34 | 0.50 | 2.40 | 2.90 | Excellent | Excellent |
| 27 | 0.8 | 0.7 | 2 | 1.1 | 138 | 99 | 28 | 110 | 0.35 | 0.50 | 2.40 | 2.90 | Excellent | Excellent |
| 28 | 0.8 | 0.7 | 2 | 0.5 | 138 | 99 | 48 | 110 | 0.61 | 0.50 | 2.40 | 2.90 | Excellent | Excellent |

As illustrated in table 1, it was figured out that the samples having the width Le of the projecting portion equal to or more than the width Lc of the front end portion of the center electrode (samples 1 through 9) exhibited relatively poor ignitability.

Further, it was confirmed that the sample having a value Sc+Sg less than 2.90 $mm^2$ (sample 10) exhibited poor durability. Further, it was confirmed that the samples having a value Sc+Sg more than 4.25 $mm^2$ (samples 11 and 12) exhibited relatively poor ignitability.

In addition, it was confirmed that the samples having a value $(\theta 1/\theta 2) \times (\theta 3/\theta 4)$ less than 0.30 (samples 13 through 15) exhibited relatively poor ignitability and durability.

Figure 9A:
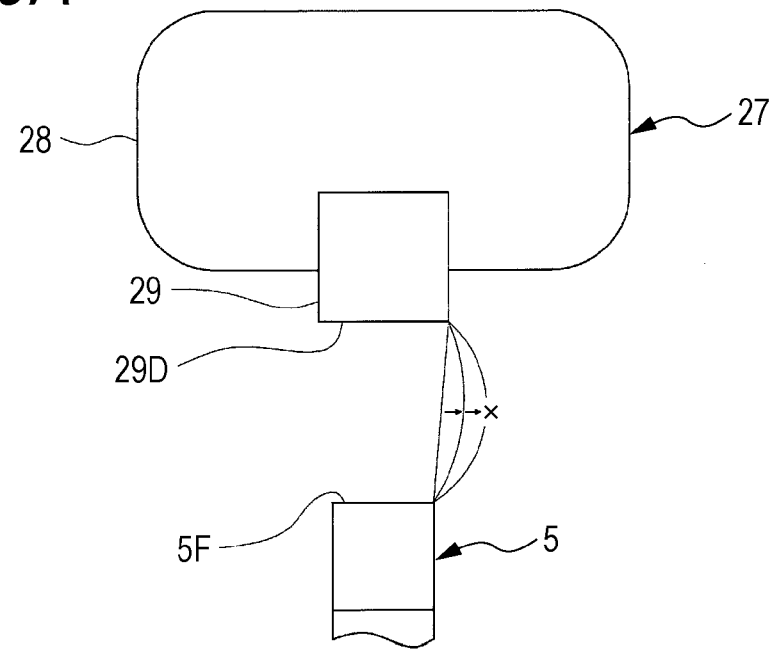
FIG. 9A is a schematic view of an aspect of a spark discharge when a width Le is equal to or more than a width Lc.
Figure 9B:
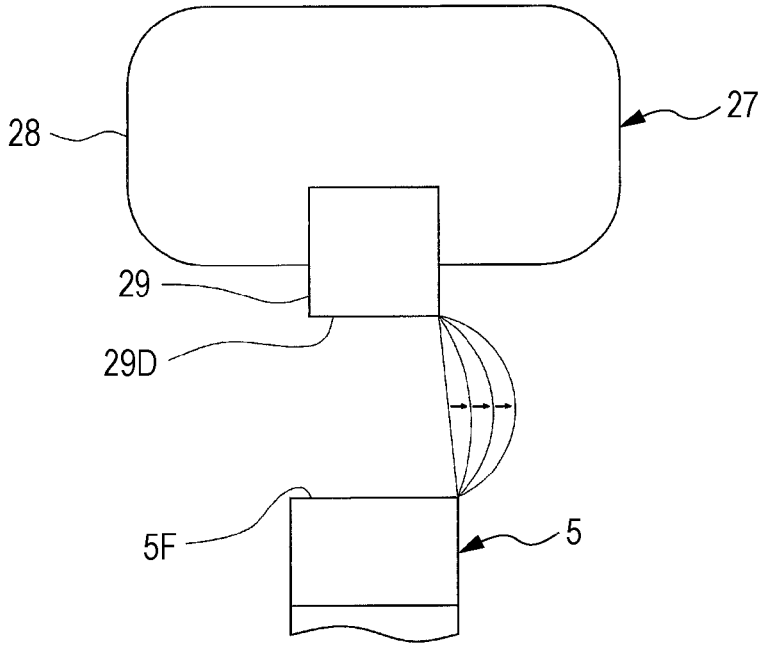
FIG. 9B is a schematic view of an aspect of a spark discharge when the width Le is less than the width Lc.

In contrast to this, it was found that the samples that satisfied the expressions Le<Lc, $2.9 \leq Sc+Sg \leq 4.25$, and $0.30 \leq (\theta 1/\theta 2) \times (\theta 3/\theta 4) \leq 0.67$ (samples 16 through 28) exhibited good performance in both ignitability and durability.

with this condition, contrary to the case where a swirl flow is generated, the spark discharge is easily blown off when the width Le is equal to or more than the width Lc, as illustrated in FIG. 9A. As a result, the spark discharge is maintained for a relatively short period of time. In other words, the ignitability cannot be sufficiently enhanced. In contrast to this, when the expression Le<Lc is satisfied, as illustrated in FIG. 9B, the spark discharge cannot be blown off easily even under the condition in which the tumble flow is generated in the combustion chamber. Consequently, the spark discharge can be maintained for a long period of time.

Regarding satisfaction of the expression $2.9 \leq Sc+Sg \leq 4.25$, the following may be considered. That is, the consumption volume of the center electrode and the main body portion is sufficiently obtained, with reducing flame quenching by the center electrode and the main body portion. Consequently, the durability and ignitability are enhanced.

Further, regarding satisfaction of the expression $0.30 \leq (\theta 1/\theta 2) \times (\theta 3/\theta 4) \leq 0.67$, the following may be considered. That is, the ignitability and durability are further enhanced without losing the operation and effect caused by the satisfaction of the expressions Le<Lc and 2.9≤Sc+Sg≤4.25.

Note that the inventors obtained the knowledge that it is preferred that the value (θ1/θ2)×(θ3/θ4) satisfy the above-described numerical range based on the following viewpoint. That is, changing the magnitude of the angles θ1 through θ4 sometimes results in an increase in ignitability while resulting in a decrease in durability. Also, changing the magnitude of the angles θ1 through θ4 sometimes results in an increase in durability while resulting in a decrease in ignitability.

Figure 10A:
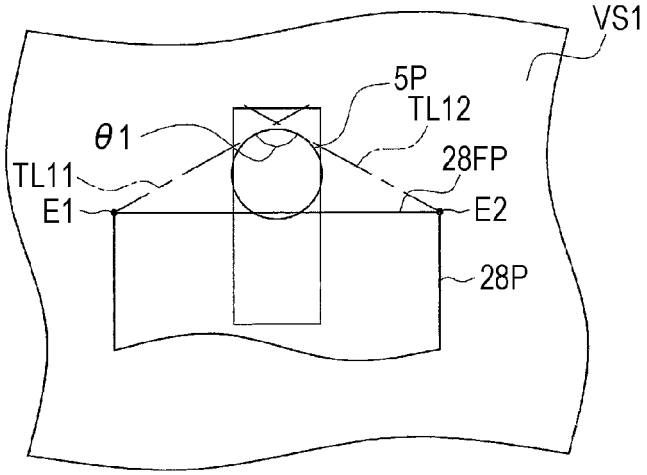
FIGS. 10A to 10C are projection views of a constitution of a ground electrode etc. when an angle θ1 is more decreased.

In particular, the following describes a case in which the width of the main body portion (in detail, a distance between both end points E1 and E2) and the outside diameter of the front end surface of the center electrode are approximately constant. In this case, the more the front end surface of the center electrode is spaced from the front end surface of the main body portion along the projecting direction of the projecting portion to the front end surface of the main body portion, the more the angle θ1 is decreased as illustrated in FIG. 10A. In this case, an area of a portion which may generate a spark discharge between the center electrode and the main body portion is reduced. Therefore, a spark discharge is easily generated concentratedly between the center electrode and the front end side of the projecting portion. Thus, the projecting portion is easily overheated, accordingly the durability is decreased. On the other hand, the more the front end surface of the center electrode is spaced from the front end surface of the main body portion, the more flame quenching by the main body portion is suppressed. Accordingly, the ignitability is increased. In addition, the more the front end surface of the center electrode approaches the front end surface of the main body portion along the projecting direction, the more the angle θ1 is increased. In this case, the durability is increased while the ignitability is decreased.

Figure 10B:
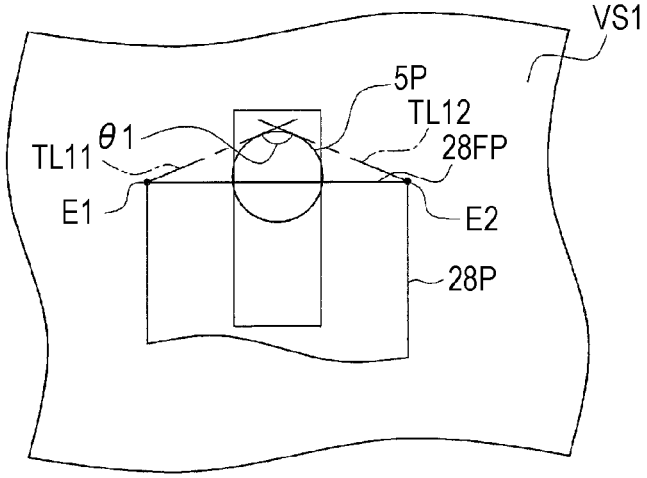

Further, the following describes a case in which the positional relation between the main body portion and the projecting portion, and the outside diameter of the front end surface of the center electrode are approximately constant. In this case, the more the width of the main body portion is decreased, the more the angle θ1 is decreased as illustrated in FIG. 10B. In this case, an area of a portion, which may generate a spark discharge with the center electrode of the main body portion is reduced. Further, with decrease in the cross-sectional area of the main body portion, the heat conduction from the projecting portion becomes insufficient (the projecting portion is easily overheated). Therefore, the durability is decreased. On the other hand, flame quenching by the main body portion is suppressed, accordingly the ignitability is enhanced. In addition, the more the width of the main body portion is increased, the more the angle θ1 is increased. In this case, the durability is increased while the ignitability is decreased.

Figure 10C:
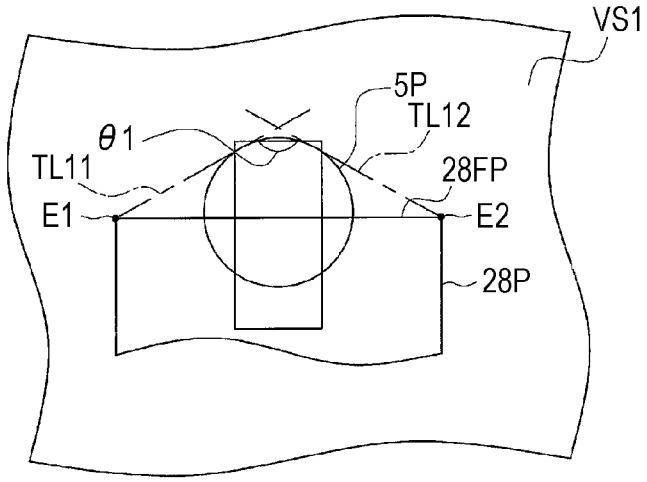

In addition, the following describes a case in which the positional relation between the main body portion and the projecting portion, and the width of the main body portion are approximately constant. In this case, the more the outside diameter of the front end surface of the center electrode is increased, the more the angle θ1 is decreased as illustrated in FIG. 10C. In this case, an area of the front end surface of the center electrode is increased. Further, with increase in volume of the center electrode, the heat conduction from the center electrode becomes sufficient. Accordingly, the durability is increased. On the other hand, flame quenching by the center electrode is increased, accordingly the ignitability is decreased. That is, even if the angle θ1 is decreased similar to the above-described cases, the superiority/inferiority of the durability and the ignitability are respectively reversed from the above-described case. In addition, the more the outside diameter of the front end surface of the center electrode is decreased, the more the angle θ1 is increased. In this case, the durability is decreased while the ignitability is increased. That is, even if the angle θ1 is increased similar to the above-described cases, the respective superiority/inferiority of the durability and the ignitability are reversed from the above-described cases.

As described above, the relation between the magnitude of the angle θ1 and the superiority/inferiority of the durability and the ignitability is not determined unambiguously.

Figure 11A:
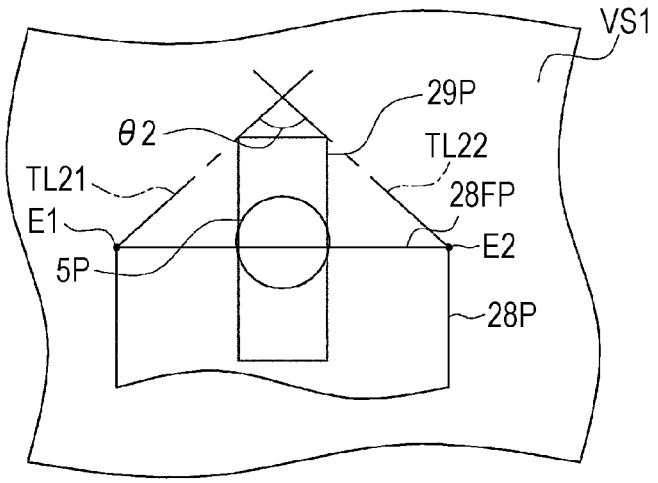
FIGS. 11A to 11C are projection views of a constitution of the ground electrode etc. when an angle θ2 is more decreased.

Also, the following describes a case in which the width of the main body portion (in detail, a distance between both end points E1 and E2) and the outside diameter of the front end surface of the center electrode are approximately constant. In this case, the more the projection length of the projecting portion relative to the front end surface of the main body portion is increased, the more the angle θ2 is decreased as illustrated in FIG. 11A. In this case, the heat is not easily conducted from the projecting portion, the projecting portion (especially, the front end portion) is easily overheated. Therefore, the durability is decreased. On the other hand, the spark discharge is easily generated at a position spaced from the main body portion. Therefore, flame quenching by the main body portion is reduced, accordingly the ignitability is increased. In addition, the more the projection length of the projecting portion is decreased, the more the angle θ2 is increased. In this case, the durability is increased while the ignitability is decreased.

Figure 11B:
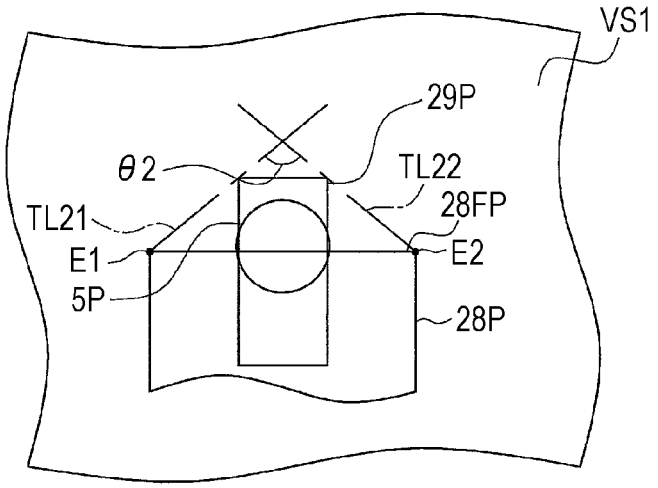

Further, the following describes a case in which the positional relation between the main body portion and the projecting portion, and the projection length of the projecting portion relative to the front end surface of the main body portion are approximately constant. In this case, the more the width of the main body portion is decreased, the more the angle θ2 is decreased as illustrated in FIG. 11B. In this case, an area of a portion, which may generate a spark discharge with the center electrode, of the main body portion is reduced. Further, the heat conduction from the projecting portion to the main body portion becomes insufficient (the projecting portion is easily overheated). Therefore, the durability is decreased. On the other hand, flame quenching by the main body portion is suppressed, accordingly, the ignitability is increased. In addition, the more the width of the main body portion is increased, the more the angle θ2 is increased. In this case, the durability is increased while the ignitability is decreased.

Figure 11C:
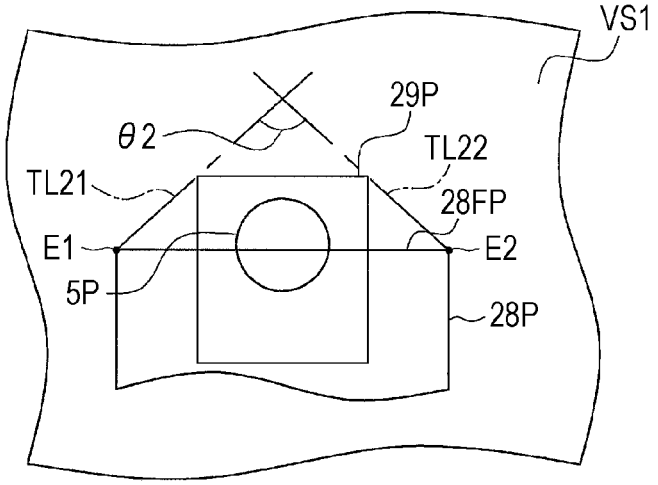

In addition, the following describes a case in which the width of the main body portion and the projection length of the projecting portion relative to the front end surface of the main body portion are approximately constant. In this case, the more the width of the projecting portion is increased, the more the angle θ2 is decreased as illustrated in FIG. 11C. In this case, an area of the discharging surface of the projecting portion is increased, accordingly, the durability is increased. On the other hand, flame quenching by the projecting portion is increased, accordingly the ignitability is decreased. That is, even as the angle θ2 is decreased similar to the above-described cases, the superiority/inferiority of the durability and the ignitability are respectively reversed from the above-described case. In addition, the more the width of the projecting portion is decreased, the more the angle θ2 is increased. In this case, the durability is decreased while the ignitability is increased. That is, even as angle θ2 is increased similar to the above-described cases, the superiority/inferiority of the durability and the ignitability are respectively reversed from the above-described cases.

As described above, the relation between the magnitude of the angle θ2 and the superiority/inferiority of the durability and the ignitability is not determined unambiguously.

Figure 12A:
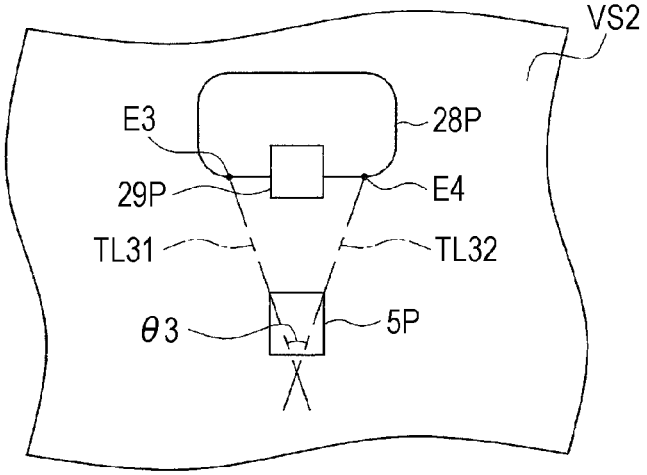
FIGS. 12A to 12C are projection views of a constitution of the ground electrode etc. when an angle θ3 is more decreased.

Also, the following describes a case in which the width of the main body portion (in detail, a distance between both end points E3 and E4) and the outside diameter of the front end surface of the center electrode are approximately constant. In this case, the more the size of the spark discharge gap is increased, the more the angle θ3 is decreased as illustrated in FIG. 12A. In this case, the spark discharge voltage is increased, accordingly, the durability is decreased. On the other hand, flame quenching by the center electrode and the main body portion is decreased, and the spark discharge gap is increased. Therefore, the ignitability is increased. In addition, the more the size of the spark discharge gap is decreased, the more the angle θ3 is increased. In this case, the durability is increased while the ignitability is decreased.

Figure 12B:
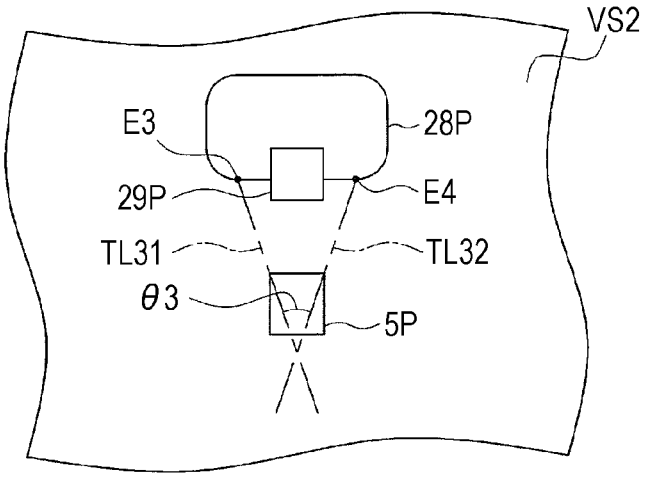

Further, the following describes a case in which the outside diameter of the front end surface of the center electrode and the size of the spark discharge gap are approximately constant. In this case, the more the width of the main body portion is decreased, the more the angle θ3 is decreased as illustrated in FIG. 12B. In this case, an area of a portion, which may generate a spark discharge with the center electrode, of the main body portion is reduced. Further, the heat conduction from the projecting portion by the main body portion becomes insufficient. Therefore, the durability is decreased. On the other hand, flame quenching by the main body portion is suppressed, accordingly, the ignitability is increased. In addition, the more the width of the main body portion is increased, the more the angle θ3 is increased. In this case, the durability is increased while the ignitability is decreased.

Figure 12C:
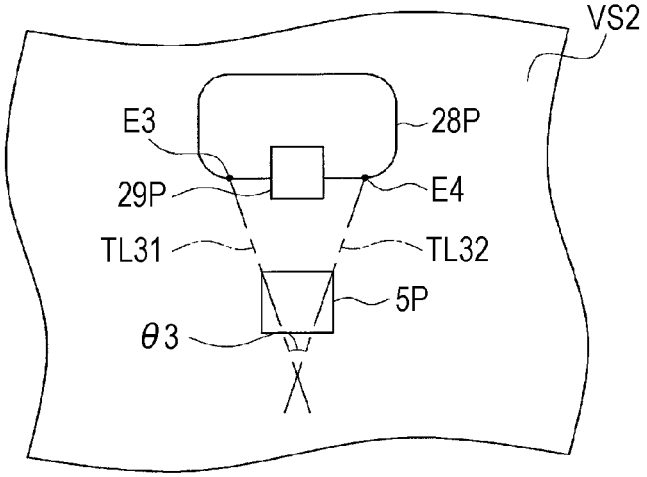

In addition, the following describes a case in which the width of the main body portion and the size of the spark discharge gap are approximately constant. In this case, the more the outside diameter of the front end surface of the center electrode is increased, the more the more the angle θ3 is decreased as illustrated in FIG. 12C. In this case, an area of the front end surface of the center electrode is increased. Further, with increase in the volume of the center electrode, the heat conduction from the center electrode becomes excellent. Therefore, the durability is increased. On the other hand, flame quenching by center electrode is increased, accordingly, the ignitability is decreased. That is, even as angle θ3 is decreased similar to the above-described cases, the superiority/inferiority of the durability and the ignitability are respectively reversed from the above-described cases. In addition, the more the outside diameter of the center electrode is decreased, the more the angle θ3 is increased. In this case, the durability is decreased while the ignitability is increased. That is, even as angle θ3 is increased similar to the above-described cases, the superiority/inferiority of the durability and the ignitability are respectively reversed from the above-described cases.

As described above, the relation between the magnitude of the angle θ3 and the superiority/inferiority of the durability and the ignitability is not determined unambiguously.

Figure 13A:
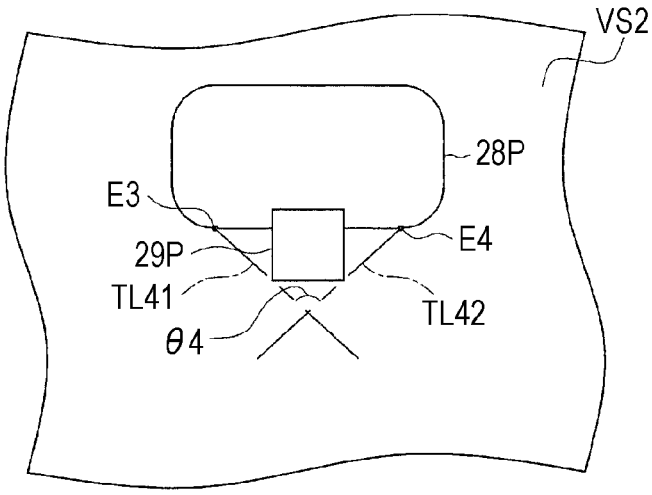
FIGS. 13A to 13C are projection views of a constitution of the ground electrode etc. when an angle θ4 is more decreased.

In addition, the following describes a case in which the width of the main body portion, the width of the discharging surface of the projecting portion, and the size of the spark discharge gap are approximately constant. In this case, the more the projection length of the discharging surface of the projecting portion relative to the internal surface of the main body portion is increased, the more the angle θ4 is decreased as illustrated in FIG. 13A. In this case, the heat conduction from the projecting portion is decreased. Further, an area of a portion, which may generate a spark discharge with the center electrode, of the main body portion is reduced. Therefore, the durability is decreased. On the other hand, flame quenching by the main body portion is decreased, accordingly, the ignitability is increased. In addition, the more the projection length of the projecting portion is decreased, the more the angle θ4 is increased. In this case, the durability is increased while the ignitability is decreased.

Figure 13B:
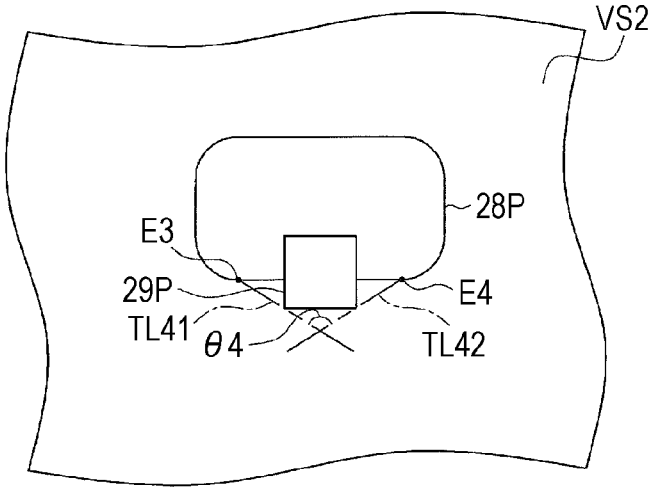

Further, the following describes a case in which the width of the discharging surface of the projecting portion and the projection length of the discharging surface of the projecting portion relative to the internal surface of the main body portion are approximately constant. In this case, the more the width of the main body portion is decreased, the more the angle θ4 is decreased as illustrated in FIG. 13B. In this case, an area of a portion, which may generate a spark discharge with the center electrode, of the main body portion is reduced. Further, the heat conduction from the projecting portion by the main body portion becomes insufficient. Therefore, the durability is decreased. Meanwhile, flame quenching by the main body portion is suppressed, accordingly, the ignitability is increased. In addition, the more the width of the main body portion is increased, the more the angle θ4 is increased. In this case, the durability is increased while the ignitability is decreased.

Figure 13C:
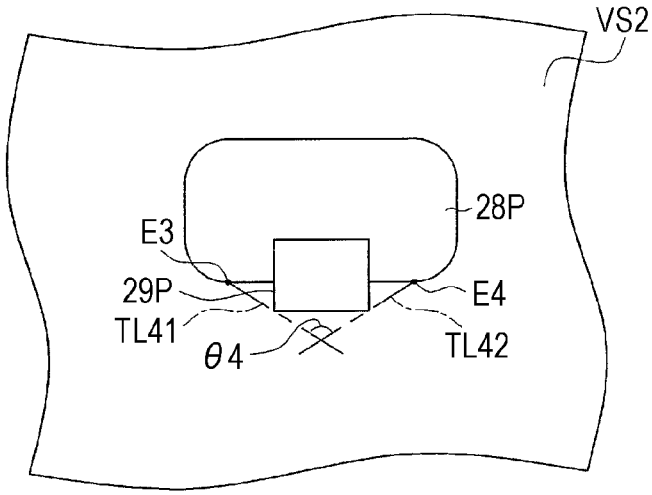

In addition, the following describes a case in which the width of the main body portion and the projection length of the discharging surface of the projecting portion relative to the internal surface of the main body portion are approximately constant. In this case, the more the width of the discharging surface of the projecting portion is increased, the more the angle θ4 is decreased as illustrated in FIG. 13C. In this case, an area of the discharging surface of the projecting portion is increased. Further, with increase in the volume of the projecting portion, the heat conduction from the projecting portion becomes excellent. Therefore, the durability is increased. Meanwhile, flame quenching by the projecting portion is increased, accordingly, the ignitability is decreased. That is, even as the angle θ4 is decreased similar to the above-described cases, the superiority/inferiority of the durability and the ignitability are respectively reversed from the above-described cases. In addition, the more the width of the discharging surface of the projecting portion is decreased, the more the angle θ4 is increased. In this case, the durability is decreased while the ignitability is increased. That is, even as the angle θ4 is increased similar to the above-described cases, the superiority/inferiority of the durability and the ignitability are respectively reversed from the above-described cases.

As described above, the relation between the magnitude of the angle θ4 and the superiority/inferiority of the durability and the ignitability is not determined unambiguously.

As described above, only a simple increase/decrease of the respective angles θ1 through θ4 may not increase the ignitability and the durability. Meanwhile, the angles θ1 through θ4 are related to the superiority/inferiority of the durability and the ignitability. Also, a change of one angle may change another angle accordingly. Thus, the angles θ1 through θ4 are closely related to one another. In view of this point, the inventors of this application devoted themselves to examination of the angles θ1 through θ4, and obtained the above-described test results. Consequently, it was found that the ignitability and the durability were enhanced when the expression $0.30 \leq (\theta 1/\theta 2) \times (\theta 3/\theta 4) \leq 0.67$ was satisfied. Also, it was found that the ignitability and the durability were further enhanced when the expression $0.32 \leq (\theta 1/\theta 2) \times (\theta 3/\theta 4) \leq 0.61$ was satisfied.

The technique of the present invention is not limited to the description in the embodiment, but may be embodied, for example, as follows. Of course, applications and modifications of this disclosure other than those exemplified below are also possible.

Figure 14A:
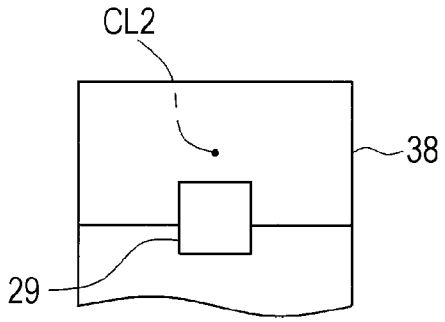
FIGS. 14A to 14D are partially enlarged side views of a constitution of a main body portion according to another embodiment.
Figure 14B:
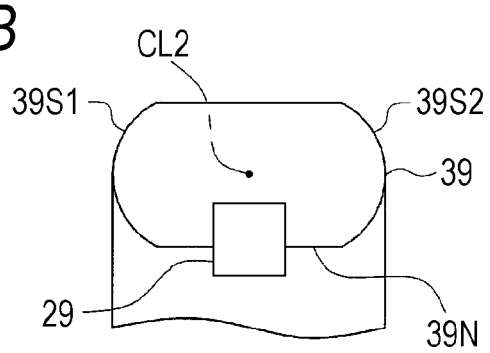
Figure 14C:
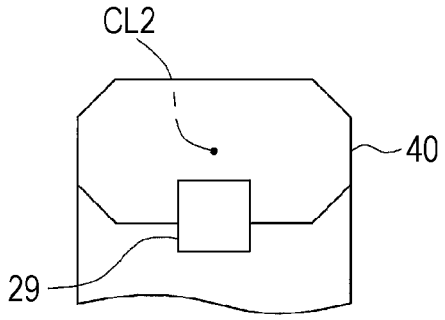
Figure 14D:
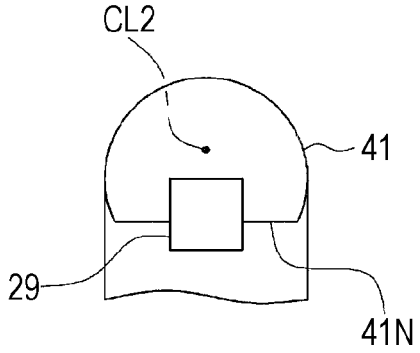

(a) In the above-described embodiment, the portions corresponding to corners of rectangular in a cross section perpendicular to the center axis CL2 of the main body portion 28 have an outwardly curved convex shape. The shape of the main body portion 28 is not limited to this. For example, as illustrated in FIG. 14A, a main body portion 38 may have a rectangular-shaped cross section. Also, as illustrated in FIG. 14B, both side surfaces 39S1 and 39S2 adjacent to an internal surface 39N of a main body portion 39 may form an outwardly curved convex surface. In addition, as illustrated in FIG. 14C, the portions corresponding to corners of rectangular in the cross section perpendicular to the center axis CL2 of a main body portion 40 may have a chamfered shape. Further, as illustrated in FIG. 14D, the outer peripheral surface other than an internal surface 41N of a main body portion 41 may have an outwardly curved convex surface.

(b) In the above-described embodiment, the projecting portion 29 has a rectangular parallelepiped shape. However, the shape of the projecting portion is not limited to this. The projecting portion may have, for example, a column shape or a polygonal column shape.

(c) In the above-described embodiment, the ground electrode 27 includes the main body portion 28 and the projecting portion 29 bonded to the main body portion 28, and the main body portion 28 and the projecting portion are different bodies. The main body portion and the projecting portion may be integrated members made of the same material.

(d) In the above-described embodiment, the center electrode 5 includes the center electrode side chip 31. The center electrode side chip 31 may not be disposed on the center electrode 5.

(e) In the concrete example of the above-described embodiment, the ground electrode 27 is bonded to the front end portion 26 of the metal shell 3. The ground electrode may be cut out from a part of the metal shell (or a part of a front end metal shell welded to the metal shell in advance) (for example, see Japanese Unexamined Patent Application Publication No. 2006-236906).

(f) In the above-described embodiment, the tool engagement portion 19 has a hexagonal cross section. However, the shape of the tool engagement portion 19 is not limited thereto. For example, the tool engagement portion 19 may have a Bi-HEX (bihexagonal) shape or the like (ISO22977: 2005 (E)).

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

Having described the invention, the following is claimed:

1. A spark plug, comprising:

a tubular insulator having an axial hole passing through the tubular insulator along a direction of an axial line;

a center electrode disposed to be inserted in a front end side of the axial hole;

a tubular metal shell disposed on an outer periphery of the insulator; and a rod-shaped ground electrode disposed at a front end portion of the metal shell, wherein:

the ground electrode includes:

a rod-shaped main body portion including a flat-shaped internal surface facing a side of a front end surface of the center electrode at a front end portion of the main body portion, the main body portion having a base end portion secured to the front end portion of the metal shell; and a projecting portion disposed at a front end portion of the main body portion in a state of projecting from a front end surface of the main body portion and the internal surface of the main body portion, the projecting portion having a width smaller than a width of the main body portion, wherein a gap is formed between a discharging surface of the projecting portion positioned at a side of the center electrode and the front end surface of the center electrode, at least a part of a projection region of the projecting portion overlaps a projection region of the front end surface of the center electrode when the front end surface of the center electrode and the ground electrode are projected along the axial line onto the first plane perpendicular to the axial line, a width Le (mm), a width Lc (mm), a cross-sectional area Sg ($mm^2$), a cross-sectional area Sc ($mm^2$), an angle θ1 (°), an angle θ2 (°), an angle θ3 (°), and an angle θ4 (°) satisfy following expressions (1), (2), and (3):

$$Le < Lc \quad (1)$$

$$2.9 \leq Sc + Sg \leq 4.25 \quad (2)$$

$$0.30 \leq (\theta 1/\theta 2) \times (\theta 3/\theta 4) \leq 0.67 \quad (3),$$

the width Le is a width of a portion in the projection region of the projecting portion, corresponding to the discharging surface of the projecting portion when the ground electrode is projected along the center axis onto the second plane perpendicular to the center axis of the main body portion at the front end portion of the main body portion, the width Lc is a width of a portion in a projection region of the center electrode, corresponding to the front end surface of the center electrode when the center electrode is projected onto the second plane along the center axis, the cross-sectional area Sg is a cross-sectional area of a portion of the front end portion of the main body portion disposed at a base end side of the main body portion with respect to the projecting portion in a cross section perpendicular to the center axis of the main body portion, the cross-sectional area Sc is a cross-sectional area of a front end portion of the center electrode in a cross section perpendicular to the axial line, the angle θ1 is formed by first tangent lines intersecting with each other at a side of the front end surface of the main body portion when the center electrode and the ground electrode are projected onto the first plane along the axial line, in which the first tangent lines are drawn from end points, respectively, that correspond to width direction ends of the front end surface of the main body portion in a projection region of the main body portion and each first tangent line comes in contact with a region of the front end surface of the center electrode at an opposite side of a base end of the main body portion with respect to a center of the center electrode in a projection region of the center electrode, the angle θ2 is formed by second tangent lines intersecting with each other at a side of a front end surface of the projecting portion when the center electrode and the ground electrode are projected onto the first plane along the axial line, in which the second tangent lines are drawn from the end points, respectively, that correspond to the width direction ends of the front end surface of the main body portion in the projection region of the main body portion and each second tangent line comes in contact with a nearest portion of the front end surface of the projecting portion to the respective end points in a projection region of the projecting portion, the angle θ3 is formed by third tangent lines intersecting with each other at a side of the internal surface of the main body portion when the center electrode and the ground electrode are projected onto the second plane along the center axis, in which the third tangent lines are drawn from end points, respectively, that correspond to width direction ends of the internal surface of the main body portion in the projection region of the main body portion and each third tangent line comes in contact with a nearest portion of the front end surface of the center electrode to the respective end points in the projection region of the center electrode and the angle θ4 is formed by fourth tangent lines intersecting with each other at a side of the discharging surface of the projecting portion when the center electrode and the ground electrode are projected onto the second plane along the center axis, in which the fourth tangent lines are drawn from the end points, respectively, that correspond to the width direction ends of the internal surface of the main body portion in the projection region of the main body portion and each fourth tangent line comes in contact with a nearest portion of the discharging surface to the respective end points in the projection region of the projecting portion.

2. The spark plug according to claim 1, wherein an expression $0.32 \leq (\theta 1/\theta 2) \times (\theta 3/\theta 4) \leq 0.61$ is satisfied.

3. The spark plug according to claim 1, wherein the projecting portion is made of a metal including platinum as a main component.

4. The spark plug according to claim 1, wherein the projecting portion is made of a metal including iridium as a main component.

5. The spark plug according to claim 2, wherein the projecting portion is made of a metal including platinum as a main component.

6. The spark plug according to claim 2, wherein the projecting portion is made of a metal including iridium as a main component.

* * * * *